US006425555B1

(12) United States Patent
Hedeman

(10) Patent No.: US 6,425,555 B1
(45) Date of Patent: Jul. 30, 2002

(54) DECORATIVE PLANT SUPPORT FOR GARDENS

(76) Inventor: Robert Hedeman, 1936 O'Malley Way, Upland, CA (US) 91784

( * ) Notice: Subject to any disclaimer, the term of this patent is extended or adjusted under 35 U.S.C. 154(b) by 0 days.

(21) Appl. No.: 09/933,538

(22) Filed: Aug. 21, 2001

(51) Int. Cl.[7] ..... A47G 7/00
(52) U.S. Cl. ..... 248/27.8; 47/41.14; 248/156
(58) Field of Search ..... 248/27.8, 156, 248/545, 314, 146; 47/41.01, 41.11, 41.14, 39

(56) References Cited

U.S. PATENT DOCUMENTS 1,879,220 A * 9/1932 Harmony ..... 248/156 X
2,241,463 A 5/1941 Keller
3,455,809 A * 7/1969 McLoad ..... 248/156 X
4,125,965 A 11/1978 Schweim
5,199,213 A 4/1993 Krebs et al.
5,685,343 A 11/1997 Smith
5,819,469 A 10/1998 Hsu
6,029,937 A 2/2000 Funaro

* cited by examiner

*Primary Examiner*—Ramon O. Ramirez
(74) *Attorney, Agent, or Firm*—Lewis M Brande; Thomas A. McCleary; Brande & McCleary

(57) ABSTRACT

A simple flower pot stand that is inserted into the soft ground wherein the device encompasses a tube with a beveled end and a flat end that is frictionally inserted into a receiving boss on the flower pot support. The flower pot support comprises a disk with a outer flange and an inner pocket to provide a reservoir for liquid that overflows from the plant pot. The receiving boss on the flower pot support is mounted on the bottom of the flower pot support.

1 Claim, 1 Drawing Sheet

DECORATIVE PLANT SUPPORT FOR GARDENS

FIELD OF THE INVENTION

This invention relates to garden accessories where the potted plants that are purchased from garden supply stores are placed in a location to maximize the visibility of the plant or flower.

BACKGROUND OF THE INVENTION

There are a number of plant stands on the market. Many of the plant stands on the market are designed to place the decorative plants at an altitude to be easily seen. These plant stands are generally made from metal in order to be more durable, and be capable of supporting great weights.

Some of the plant stands are also capable of being produced in multiple components, which allows the owner to create a variety of styles of plant stands for very little expenditure of money.

Accordingly, it is a primary object of the invention to create an improved plant stand that can be easily incorporated into existing landscaping without damaging, modifying, or changing the existing landscaping.

DESCRIPTION OF THE PRIOR ART

U.S. Pat. No. 2,2441,463 by E. D. Keller, discloses a "Ground Supported Plant Holder." This invention is an inverted cone that has a spiked support that is inserted into the ground in order to support the inverted cone. The inverted cone in hollow and has plants deposited within the cone portion. The inverted cone is easily able to hold the dirt that the flower or plant needs for survival. The invention takes the place of the flower pot.

U.S. Pat. No. 4,125,965 by Walter C. G. Schweim, discloses an "All Purpose Flower Stand." This invention discloses a hollow container that is attached to a vertical post. The vertical post is threaded into the hollow container, and has a cruciform support to aid in stabilizing the hollow container. The hollow container is bifurcated, creating a lower portion which has the capability to keep the flowers moist. The upper portion of the hollow container is made to receive the dirt for the flowers and the plants. In other words the hollow container is the flower pot. The vertical post may be inserted into the ground, imbedded in concrete, or attached to a cruciform base for stability.

U.S. Pat. No. 5,199,213 by Krebs et al., discloses a "Cemetery Plant Pot." This plant pot structure is designed specifically to be used in cemeteries, where it is necessary to secure the plant stand to the support. The vertical post has a disk that is threadably attached to a threaded pedestal bore of an associated pedestal support. The vertical post is threadably attached to a conical pot container, which supports flower pots.

U.S. Pat. No. 4,685,343 by Smith, discloses a "Decorative Pipe Tubing Cover." This invention relates to visual concealment of existing well pipes, that typically protrude above the ground and are generally hazardous, because of the difficulty in seeing the well pipes. The vertical post of the pipe tubing cover is attached to the well pipe by a series of set screws. The top of the post has a platform. The platform also has a recess to support objects.

U.S. Pat. No. 4,819,469 by Hsu, discloses a "Support Plate for Flower-Pots that prevents Overflow and Inhibits Mosquito Propagation." This invention discloses a disk that has a hollow portion to allow water to seep into. This cavity helps inhibit mosquitos from laying eggs. The disk has radial supports, and wheels to assist the owner in moving flower or plant pots around smooth surfaces U.S. Pat. No. 6,029,937 by Funaro, discloses a "Floral Stand with Interchangeable Components." This invention discloses multiple interchangeable components that are threadably coupled together for quick and easy assembly and disassembly. The container is interchangeable with other containers to accommodate various floral arrangements or candles. The lower portion of the vertical support is enlarged to provide stability, but is also hollow and can have ballast added for additional stability.

SUMMARY OF THE INVENTION

The following description is provided to enable a person skilled in the art to make and use the invention and sets forth the best modes contemplated by the inventor for carrying out his invention. Various modifications, however, will be readily apparent to those skilled in the art, since the generic principles of the present invention have been defined herein specifically to provide for an improved plant stand.

The object of this invention is to create a plant stand that is easy to assemble, durable, low cost, and is pleasing to look at.

Another object of the invention is to provide a plant stand that will position flowers above existing landscaping without any modification or damage to existing landscaping.

The objects of this invention is achieved by having a vertical post that has on one end a diagonal cut, and the other end is cut normal to the post axis. A horizontal plate has a central boss on the lower portion, where the central boss has a hole to receive the vertical post in a slip fit. The horizontal plate has an outer ridge that helps prevent water from dripping away from the horizontal plate. The diagonal end is inserted into the ground in an essentially vertical position. This allows the owner to place a flower pot on the top side of the horizontal plate. This will allow the flowers to be readily seen by viewers, since the flower will be positioned above the surrounding landscaping.

DETAILED DESCRIPTION

Figure 1:
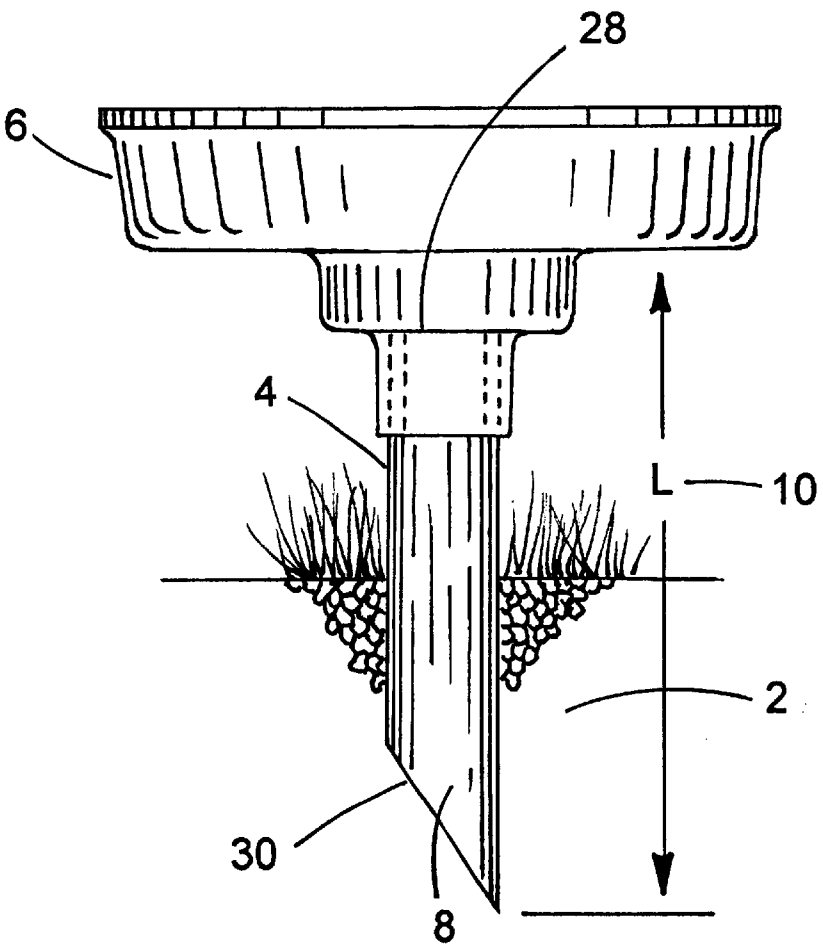
FIG. 1 shows an overall view of the Plant-Tee inserted into the ground

With respect to FIG. 1, a decorative plant support (2) consists of a support tube (4), the support tube having a length (10), an upper portion (28), and a lower portion (30). The lower portion (30) of the support tube (4) has a bevel or diagonal cut (8) defined thereon, the diagonal cut (8) allowing the support tube (4) to be easily inserted into the soil of a garden. A support platform (6) is shown attached to the upper portion (28) of the support tube (4).

Figure 2:
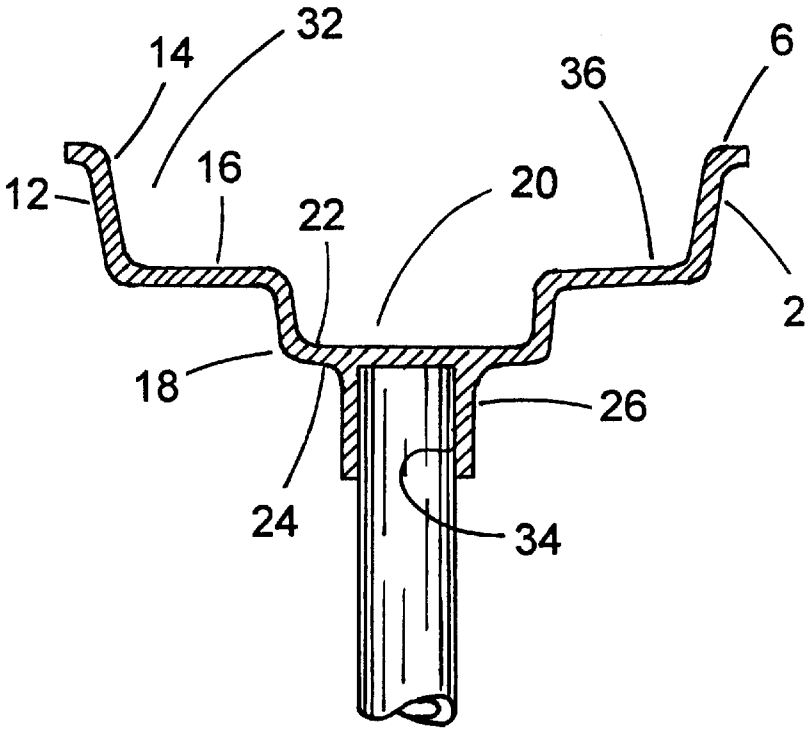
FIG. 2 is a cross sectional view (Sect A—A) of the Plant-Tee showing the relative components of the invention.

With respect to FIG. 2, the decorative plant support (2) is shown in cross section depicting the various components of the support platform (6). The support platform, (6) is shown having an outer edge (12), the outer edge (12) having an annular ring (14) extending upwards defining an internal pocket (32) therein. A support surface (16) resides at the bottom of the internal pocket (32) providing support for potted plants. The support surface (16) has a lower surface (36) defined thereon. A first central boss (18) is attached to the support platform (6) and is facing downwards from said lower surface (36) of said support surface (16). The support surface (16) has a hollow pocket (20) thereby defined co-incident within the first central boss (18). The first central boss (18) has a lower surface (24) defined thereon. A second central boss (26) is centrally positioned on the lower surface (24) of the first central boss (18). The second central boss (26) has a central pocket (34) defined therein, the central pocket (34) is downward facing allowing the support tube (4) to mate therewith.

What is claimed is:

1. A decorative plant support comprising: a) a support tube, said support tube having an upper portion and a lower portion, said lower portion of said support tube having a bevel cut defined thereon; and b) a support platform, said support platform having an outer edge, said outer edged having an annular ring defined thereon, said annular ring projecting upwards from a support surface thereby defining an internal pocket therein, said internal pocket using said support surface to position plant pots thereon, a first central boss, said first central boss projecting downwards from a lower surface of said support surface, said first central boss having a hollow pocket defined therein, said hollow pocket facing upwards from said support surface, said first central boss having a lower surface, a second central boss, said second central boss projecting downwards from said lower surface of said first central boss, said second central boss having a central pocket defined therein, said central pocket of said second central boss allowing said upper portion of said support tube to mate therewith, and having a tight slip fit.

* * * * *